US006068005A

United States Patent [19]

Diamond et al.

[11] Patent Number: 6,068,005

[45] Date of Patent: May 30, 2000

[54] CAN WASHING SYSTEM

[75] Inventors: George B. Diamond, Glen Gardner; Ralph Helmrich, Asbury, both of N.J.

[73] Assignee: Dispensing Containers Corp., Glen Gardner, N.J.

[21] Appl. No.: 09/226,888

[22] Filed: Jan. 7, 1999

Related U.S. Application Data

[60] Provisional application No. 60/070,724, Jan. 7, 1998.

[51] Int. Cl.[7] ..... B08B 3/02; B08B 9/093

[52] U.S. Cl. ..... 134/167 R; 134/168 R

[58] Field of Search ..... 134/15, 22.1, 22.18, 134/23, 32, 62, 72, 129, 131, 167 R, 168 R

[56] References Cited

U.S. PATENT DOCUMENTS

| | | | |
|---|---|---|---|
| 899,017 | 9/1908 | Arnold | 134/129 |
| 1,144,023 | 6/1915 | Beutlich | 134/72 |
| 1,171,100 | 2/1916 | Dawson | 134/72 |
| 1,212,747 | 1/1917 | Dawson | 134/72 |
| 1,232,175 | 7/1917 | Baenninger | 134/72 |
| 1,761,450 | 6/1930 | McKechnie | 134/129 |
| 3,353,515 | 11/1967 | Stolle et al. | 134/72 |
| 3,955,588 | 5/1976 | Born | 134/129 |

*Primary Examiner*—Randy Gulakowski
*Assistant Examiner*—Saeed Chaudhry
*Attorney, Agent, or Firm*—Ostrolenk, Faber, Gerb & Soffen, LLP

[57] ABSTRACT

A washing system for cans in which interior washing nozzles move in synchronization with the cans and are axially centered with the cans and in which a washing jet impinges directly on the interior bottom of a can and exits by flowing along the interior side wall surface of the can parallel to the centerline of the can.

7 Claims, 7 Drawing Sheets

CAN WASHING SYSTEM

RELATED APPLICATIONS

This application is based on Provisional Application Serial No. 60/070,724 entitled "Can Washing System, filed Jan. 7, 1998.

BACKGROUND OF THE INVENTION

The present invention relates to a system of washing cans and, in particular, to an improved system for washing the inside of cans.

The washing of cans to remove lubricants used in forming the cans, debris, and other contaminants is usually done by passing cans over and under fixed spray nozzles. The cans usually are moved by a moving horizontal belt. There are also washers which use pins on which the cans are placed to move them vertically and horizontally while spray nozzles are used to spray the inside and outside of the can. There are also washers where the cans move horizontally on a belt or other device that moves the cans. In this case, the nozzles are horizontal for the interior wash and outside bottom wash, and vertical or partly vertical for the exterior wall wash.

All these systems use a large number of nozzles with relatively small orifices, and produce a fine spray. In all of these systems the interior washing of the can takes place in a random fashion since the cans and nozzles are not synchronized and the spray hits the interior of the can at various points.

Due to this random spraying of the can interior, the lubricant and/or other contaminants are randomly moved about the interior of the can, and their complete removal requires a spray time of 10 seconds or more depending on the number of nozzles and the rate of can washing. For cans being washed at a rate of 500 per minute, several thousand nozzles are used and the wash time can be as long as 20 seconds or more. This results in a cumbersome and expensive system. (The outside of the cans are also usually washed randomly with a fine spray.)

SUMMARY OF THE INVENTION

It is an object of the present invention to provide an improved can washing system which washes cans more effectively, in shorter time and is considerably less expensive then predecessor systems.

These and other objects are achieved by a washing system for cans which has can interior washing nozzles which move in synchronization with the cans.

Preferably, the nozzles are axially centered with the container and emit a washing jet which impinges directly on the interior bottom and exits by flowing along the interior side wall surface of the can parallel to the centerline of the container.

Other features and advantages of the present invention will become apparent from the following description of the invention which refers to, the accompanying drawings.

DETAILED DESCRIPTION OF THE PREFERRED EMBODIMENTS

Figure 1:
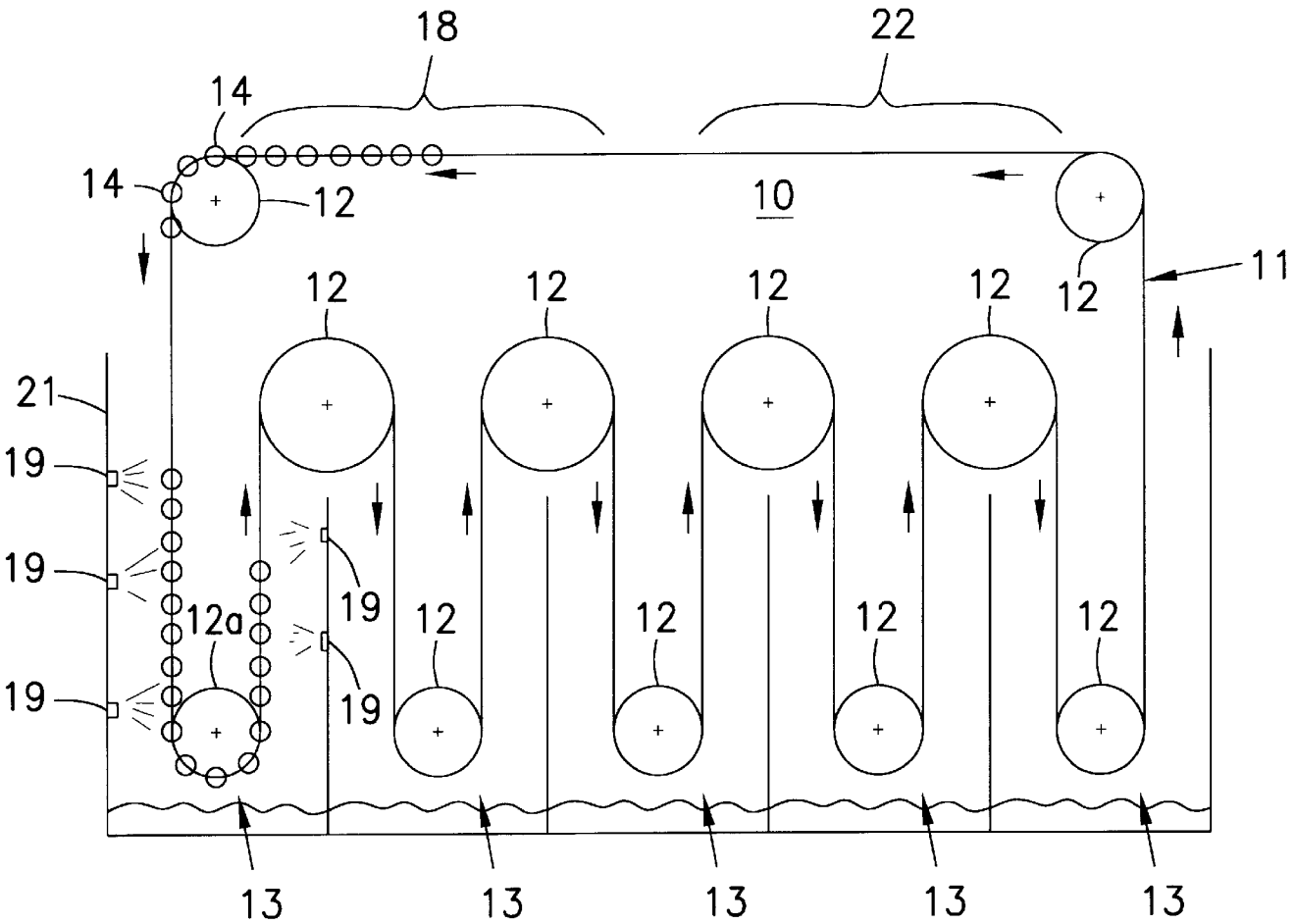
FIG. 1 shows a schematic plan view of a first embodiment of a can washing system in accordance with the present invention using closed-sided cages.

Referring to the drawings and, more particularly, to FIG. 1, there is shown a can washing system 10 embodying certain features of the present invention. The system 10 includes a conveyor 11, which preferably is in the form of a conveyor chain entrained around a plurality of wheels 12, one of which is a drive wheel 12*a* which drives the conveyor 11 to move the conveyor 11 into and out of a plurality of wash tanks 13, the drive wheel 12*a* being located in one of the tanks 13.

Cans 14 to be washed are inserted into washing cages 16 attached to the links 17 (FIGS. 2A and 2B) of the conveyor 11 at a loading station 18 and then moved into and out of the tanks 13 by the conveyor 11. At least one of the tanks 13 has a plurality of nozzles 19 on the sidewalls 21 thereof arranged to spray washing fluid on the exterior of the cans 14 and thereby clean the external surfaces. After exiting from the last one of the tanks 13, the cans 14 are removed from the washing cages 16 at an unloading station 22.

Figure 2A:
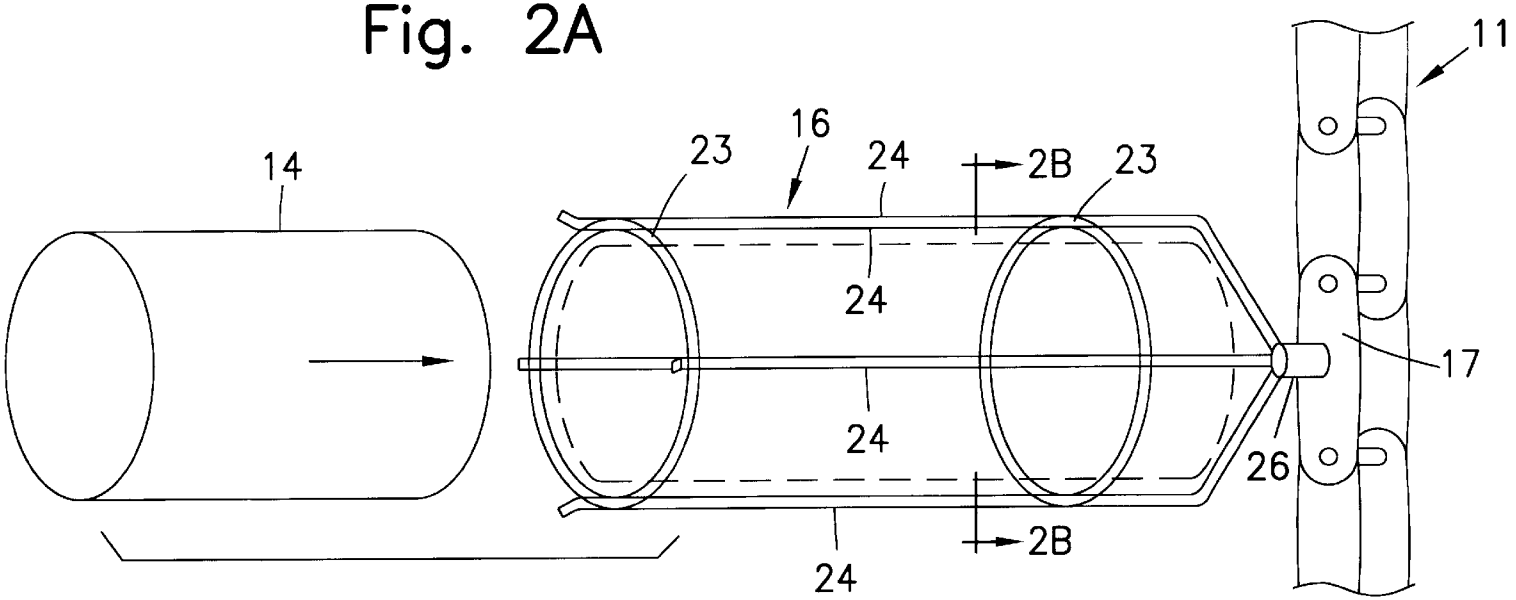
FIG. 2A is an exploded perspective view showing a can being inserted in a closed-sided cage.
Figure 2B:
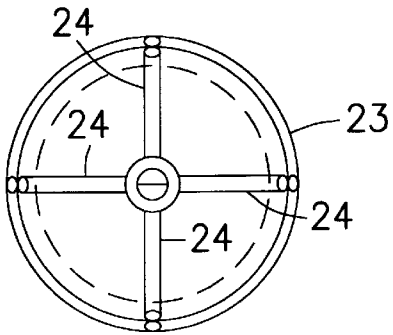
FIG. 2B is a cross section taken along the lines 2B—2B of FIG. 2A.

As seen in FIGS. 2A and 2B, each of the washing cages 16 includes a plurality of support rings 23 and a plurality of rods 24 longitudinally disposed about the support rings 23 and attached thereto by suitable means. The rods 24 are also attached to a pin 26 which is then suitably attached to one of the links 17 of the conveyor 11 by any suitable means.

The inside diameter of a cage 16 is slightly larger than the outside diameter of a can 14 so that, although a can 14 may be easily moved in and out of a cage 16, it is held therein centered with the center axis of the cage 16.

The cages 16 may be made of metal, plastic or other suitable materials and may be fabricated by assembling the component parts together or, if made of plastic, may be fabricated by an injection molding process.

Figure 3:
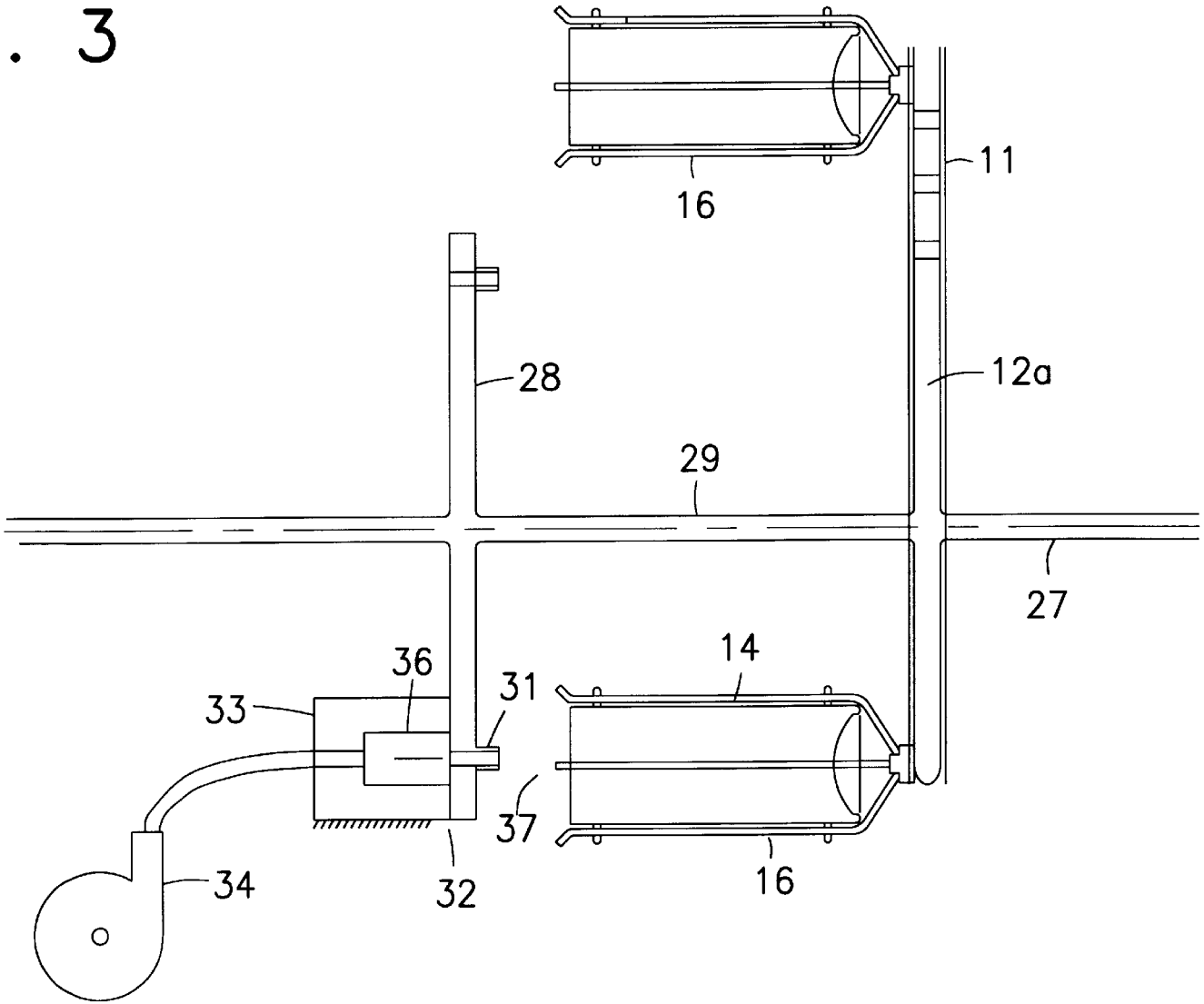
FIG. 3 is a schematic plan view of a portion of the system of FIG. 1 showing a nozzle arranged to move synchronously in alignment with a can being washed.

Referring now to FIG. 3, the wheel 12*a* includes chain drive teeth (not shown) for engaging the links 17 of the conveyor 11 and is driven by a shaft 27 connected to a suitable drive unit (not shown). Spaced from the wheel 12*a* is a nozzle plate 28 which is connected to the wheel 12*a* by another shaft 29 so that the nozzle plate 28 rotates synchronously with the wheel 12*a*. A plurality of nozzles 31 are mounted on the plate 28. Each of the nozzles 31 is connected by means of a sliding seal 32 to a stationary valve manifold 33 connected to a suitable pump 34. The pump 34 forces fluid into the valve manifold 33. As a moving nozzle 31 communicates with a chamber 36 in the valve manifold 33, fluid is forced through the nozzle 31 forming a washing fluid jet 37 directed into the interior of a can 14 to be washed.

Figure 4:
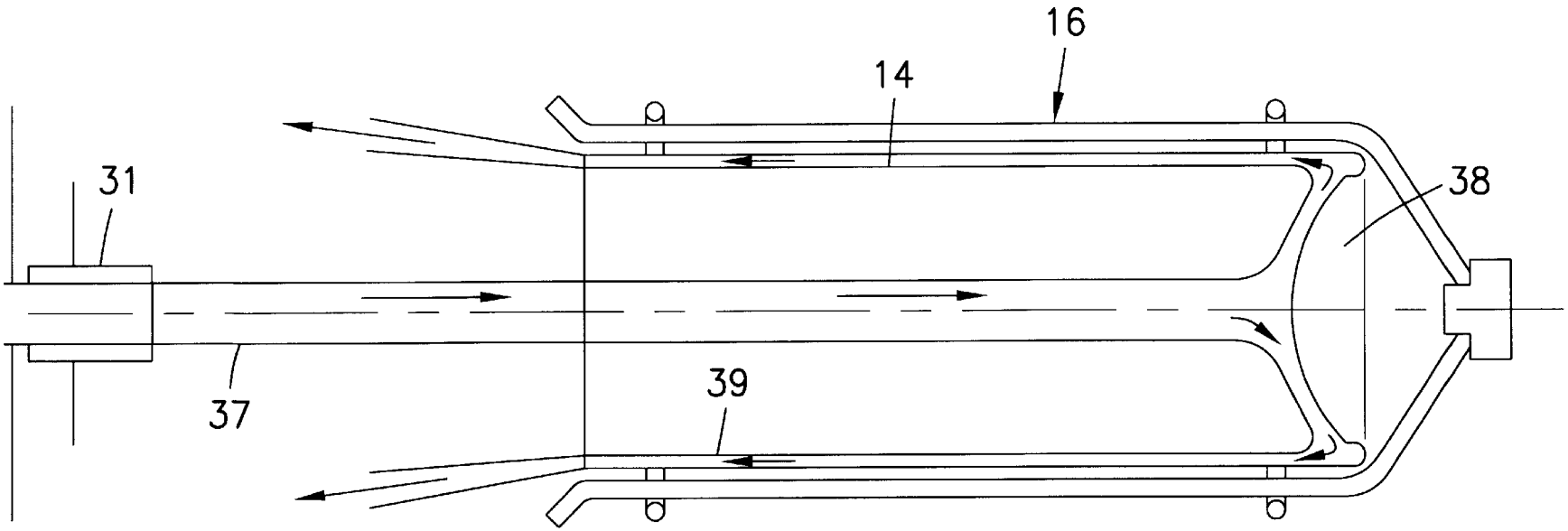
FIG. 4 is a schematic sectional view showing a jet of water from a nozzle impinging on the inside and bottom of a can and an annular film of water leaving the can.

The nozzles 31 are always aligned with the longitudinal axis of the can 14 during the washing process. This insures that the jet 37 will be perfectly aligned with the can 14 for the most efficient washing action. More specifically, referring to FIG. 4, the high-pressure, high-volume jet 37 of washing liquid (aligned with the axis of a can 14) impacts the bottom 38 of a can 14, turns 180° (following the contour of the can bottom) and returns along the can wall in an annular film 39, washing the cans walls as it does so. There is minimal back mixing of exiting washing liquid with the entering liquid and, accordingly, contaminants are carried directly out of the can 14 maximizing the washing efficiency.

The exteriors of the cans 14 are washed by a continuous spray of the fixed nozzles 19 (FIG. 1), although moving nozzles can also be used. Since the exteriors are open to the washing spray, in contrast to the interiors which are constrained by the can walls, it is much easier to wash the exteriors without an aligned spray.

After each stage of the washing cycle, the excess liquid can, if necessary, be removed by an air blast.

In order to wash cans 14 completely, several washing stages are used (five in the embodiment of FIGS. 1–4). The number of stages depends on the type of lubricants and washing chemicals that are used. Three or more stages are generally used in order to minimize regeneration of any deionized wash water, to make recovery of the lubricant easier and to minimize the use of water.

If the lubricant used requires chemical additives to the wash water for its removal, then usually a plain water wash to mechanically remove a portion of the lubricant is used in the first stage. (This decreases the chemical usage.) Chemicals are used in the second stage to remove the balance of the lubricant. Plain water is used in the third stage (and sometimes fourth stage) to remove the chemicals, and deionized water is used in the last (fourth or fifth) stage to remove the plain water.

In the case of water-soluble lubricants, plain water is used in the first and second stages and, if necessary, in the third stage, and deionized water is used in the last stage.

In all cases, countercurrent flow is preferred in order to minimize water use.

The embodiments described herein use a continuous chain drive which conveys the cans 14 in a horizontal position, and is synchronized with the interior washing nozzle drive. Available washing time per stage is determined as follows:

R=Rotational speed of the drive in rpm (revolutions per minute)

N=Number of cans per revolution of the washing sprocket, and equals the number of synchronized nozzles.

NR=Washing speed in cans per minute (CPM).

Washing time in seconds=60/(2R).

For a speed of 600 cans per minute with N=12, R equals 600/12 or 50 rpm, and the washing time equals 60/(2*50)= 0.6 seconds.

We prefer to keep the wash time below one second, and the exact time is balanced out with the economics of size of the equipment and other factors.

The diameters of the nozzle plate 28 and the drive wheel 12*a* are adjusted to hold the required number of nozzles 31 and cans 14 for the can spacing on the drive chain 11 in correspondence with the diameter of the can 14.

The wash liquid is re-circulated from each wash stage to both the interior and exterior wash nozzles 31 and 19, respectively, by pumps (not shown), and make-up rinse liquid (not shown) is added at the final stage and moves by overflow from stage to stage and is taken off by an overflow mechanism (not shown) at the first stage. Make-up wash chemicals (if used) are added at the appropriate stage. These are well-known technologies and are therefore not shown in detail in the figures.

Figure 5:
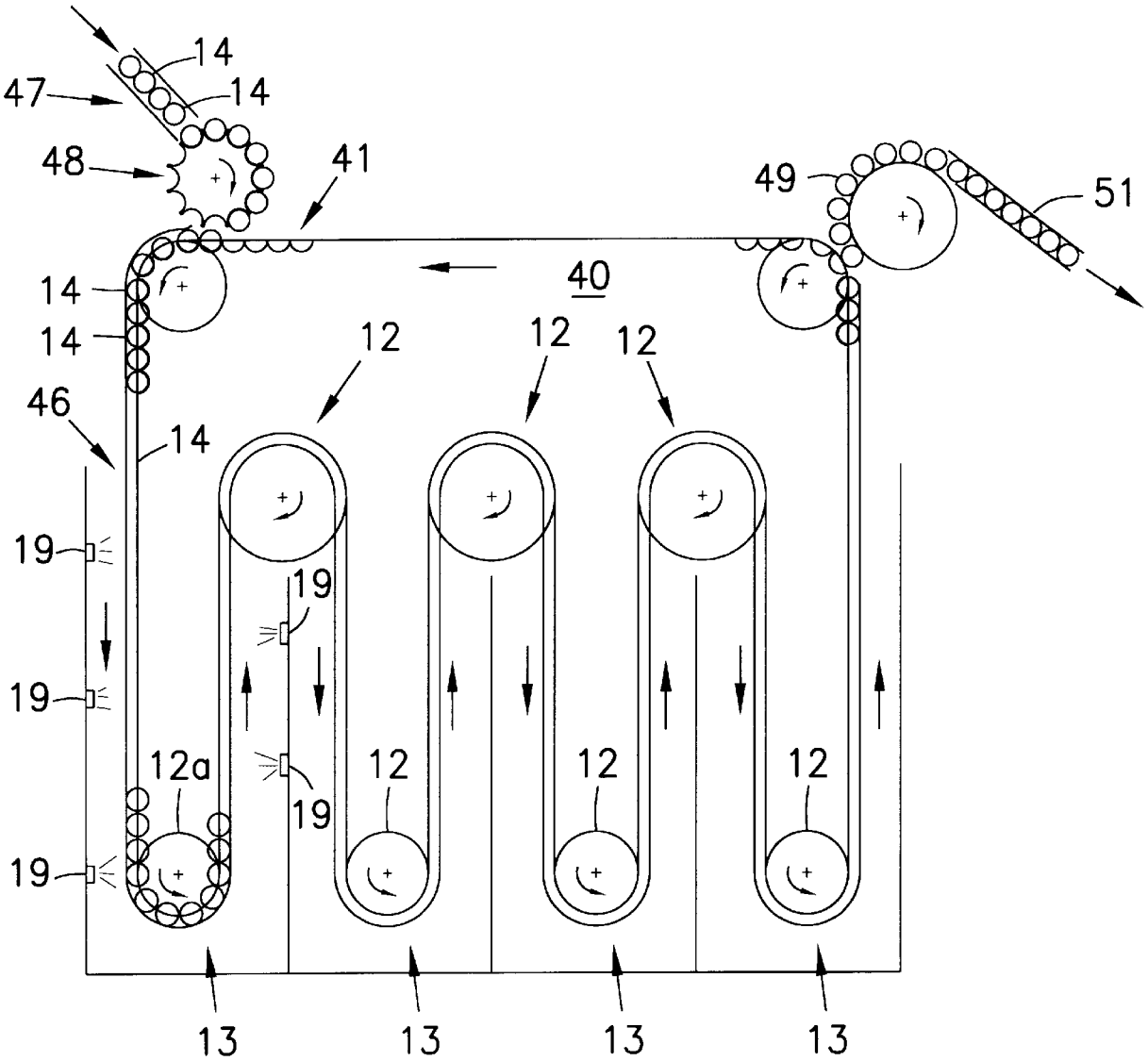
FIG. 5 shows a second embodiment of a can washing system in accordance with the invention utilizing open-sided cages.

Referring now to FIG. 5, there is shown a second embodiment of a can washing system 40 in accordance with the invention which utilizes open-sided cages 41. Elements in this embodiment which are the same as those in the embodiment of FIGS. 1–4 have the same reference numerals and are not described in detail.

Figure 6:
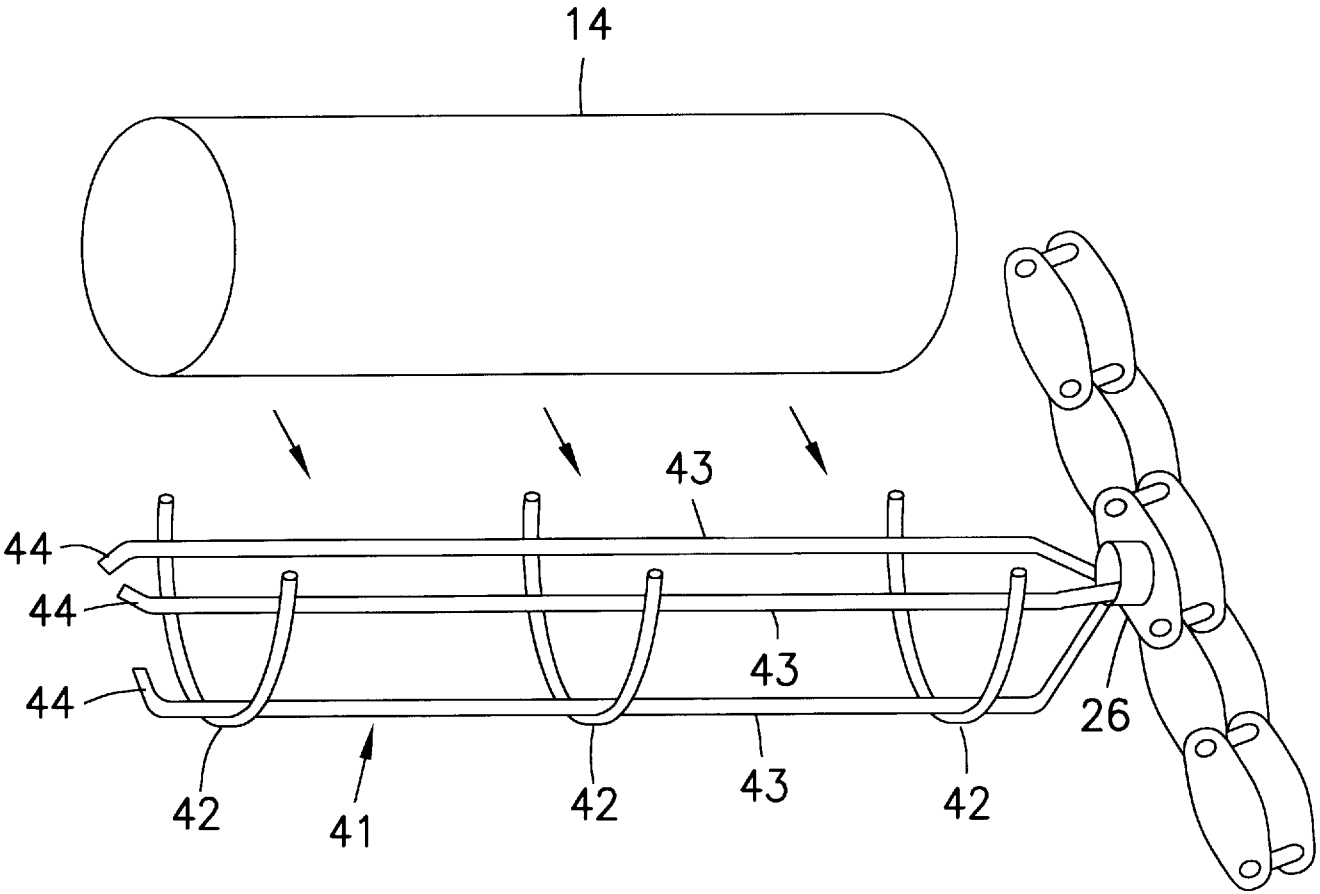
FIG. 6 shows an open-sided cage and a can falling into the cage.
Figure 7:
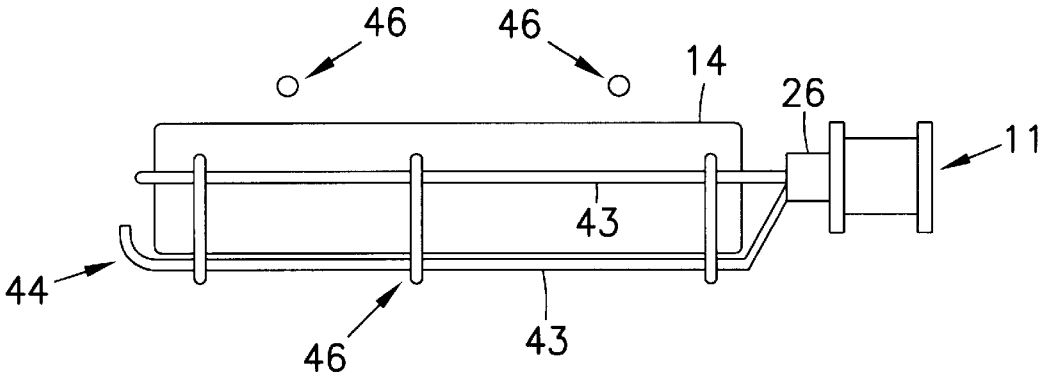
FIG. 7 shows a side view of a can in an open-sided cage with a guide rail and a bent-in cage end which together retain the can within the cage.
Figure 8:
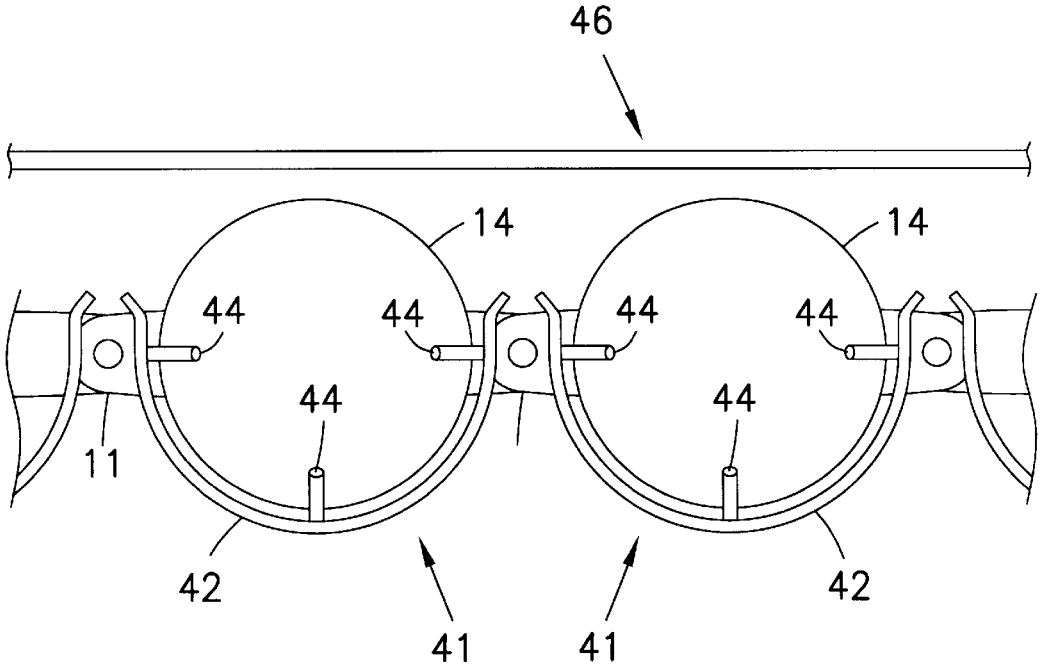
FIG. 8 shows an end-view of the open-sided cage with the guide rail and bent-in cage ends.

Referring to FIGS. 6–8, the open-sided cage 41 is essentially semi-cylindrical in shape and includes a plurality of semi-circular support rings 42 and rods 43 and is connected to the links 17 of the conveyor 11 by a pin 26. In accordance with this cage construction, one of the sides is open so that a can 14 may be dropped into the cage 41 from above the cage 41. The cage 41 includes bent ends 44 for restraining longitudinal movement of the can therein. In order to restrain lateral movement of the cans, a pair of guide rails 46 are provided. Thus, the guide rails 46 prevent a can 14 from falling out of the side of a cage 41 while the bent-in ends 44 or similar restraints keep the cans from sliding out of the cage 41.

Like the cage 16 of the first embodiment, the cage 41 of this embodiment may be metal or plastic and may be fabricated from individual parts assembled together or may be injection molded in the case of plastic.

Turning back to FIG. 5, cans 14 to be washed are fed down a chute 47 to an infeed star wheel 48 which rotates and drops the cans 14 one by one into respective open-sided cages 41. Alternative feed systems such as vacuum or magnetic can also be used. The cans 14 are then conveyed by the conveyor 11 into a plurality of the tanks 13, at least one of which has external nozzles 19 for washing the exterior of the cans and nozzles 31 arranged as in FIG. 3 for washing the interior of the cans. (Only four tanks are shown in FIG. 5, however, as discussed above, the number of tanks is not critical and will vary depending upon a number of factors.) After exiting from the last stage, the cans 14 go to an unloading station where they are removed from the cages 41 by any suitable means such as a magnetic or vacuum pick off wheel 49 which feeds the cans 14 into an unloading chute 51.

As should now be apparent, we have invented a washing system that does not depend on random impingement of a spray into the interior of the can. Our washing system requires exposure of the interior of the can to the washing stream for a duration of less than one second, and therefore dramatically reduces the size and cost of the washing system. Obviously longer washing times can be used.

This has been achieved by a single high-velocity, high-volume jet directed at the very center of the interior bottom 38 of a can 14. This jet is reflected by the bottom 38 and exits the can 14 along the interior side wall, removing the lubricant and debris in a fraction of a second.

For example, for a can 14 that is 2 inches in diameter and 6 inches long, if the jet rate is about 72 liters per minute, with a nozzle diameter of 1.27 centimeters, a velocity of 9.5 meters per second is achieved and a washing time of about one-quarter (¼) of a second removes the lubricants normally used in forming the can, plus any incidental debris.

Although the present invention has been described in relation to particular embodiments thereof, many other variations and modifications and other uses will become apparent to those skilled in the art.

Thus, the can 14 may be held horizontally, as described above, or it may also be held partly or totally upside-down with a retaining system to keep it from falling out. Any number of ways of holding the can 14 at various angles can be used as long as the jet is parallel to the center line of the can and is reasonably centered with the can bottom. For example, the cans 14 may be held mechanically or magnetically within cages attached to the drive chain or may be directly attached to the drive chain by suitable means, such as magnets.

The alignment of the nozzle 31 with the center axis of the can 14 can be achieved in a number of ways:

1. A belt or other can transport mechanism may be indexed into and out of alignment with stationary nozzles. In this case, the index mechanism stops the cans for the required duration of the wash cycle in alignment with the stationary nozzles; or 2. The belt or other transport mechanism may move the cans continuously, and the nozzles may move in synchronization with the cans (as in the embodiments of FIGS. 1

The term "can" as used herein and in the appended claims means any receptacle, such as a metal can, a plastic container, a glass container, a jar or any similar object the inside of which requires washing.

It is preferred that the present invention be limited not by the specific disclosure herein, but only by the appended claims.

What is claimed is:

1. An apparatus for washing cans having respective open and closed ends, comprising:

an endless chain;

a plurality of wheels about which the chain is entrained for driving and guiding the chain;

a plurality of holders mounted on the chain for holding a plurality of cans to be washed such that the open ends thereof face respective ones of the nozzles with respective central longitudinal axes of the cans being in alignment with respective nozzles;

a plurality of nozzles mounted about the periphery of a support member arranged to rotate with one of the wheels so that the nozzles move synchronously with the cans for washing the same, the holders holding the cans such that the open ends thereof face respective ones of the nozzles with respective central longitudinal axes of the cans being in alignment with respective nozzles and the nozzles being structured and arranged to emit washing fluid in the form of respective jets substantially axially aligned with the central longitudinal axes of respective ones of the cans such that each jet impinges upon the closed end of a respective can and exits by flowing along interior side wall surfaces of the can parallel to the central longitudinal axis thereof; and means for ejecting a single jet through each nozzle so that each can is subjected to only a single jet of washing fluid.

2. An apparatus according to claim 1, wherein the holders comprise respective cages.

3. An apparatus according to claim 1, wherein the support member is a plate arranged to rotate with one of the wheels and the nozzles are mounted about the periphery of the plate.

4. An apparatus for washing cans according to claim 3, wherein the plate is connected to the one wheel by a shaft.

5. A system for washing the inside and outside of a plurality of cans each of which has an open end and a closed end, which system comprises:

an endless chain;

a plurality of wash tanks;

a plurality of wheels about which the endless chain is entrained for driving and guiding the chain, at least one wheel of the plurality of wheels being located in each of the tanks;

the endless chain and the plurality of the wheels being so arranged with respect to the tanks that the chain is moved into and out of each of the tanks;

a plurality of holders on the chain for holding the cans;

a first plurality of nozzles arranged on the sides of at least a first one of the tanks, the cans being moved into and out of the one tank such that the external side walls and bottom of the cans face the nozzles;

a second plurality of nozzles arranged in one or more of the tanks such that the nozzles face the open ends of the cans and move synchronously with the cans for washing the insides of the cans, the holders holding the cans such that the open ends thereof face respective ones of the nozzles with respective central longitudinal axes of the cans being in alignment with respective nozzles and the nozzles being structured and arranged to emit washing fluid in the form of respective jets substantially axially aligned with the central longitudinal axes of respective ones of the cans such that each jet impinges upon the closed end of a respective can and exits by flowing along interior side wall surfaces of the can parallel to the central longitudinal axis thereof; and means for ejecting a single jet through each nozzle of the second plurality of nozzles so that each can is subjected to only a single jet of washing fluid.

6. A system as in claim 5, wherein the second plurality of nozzles is mounted on a nozzle plate arranged to rotate with one of the wheels of the plurality of wheels located in one or more of the tanks.

7. A system as in claim 5, wherein the holders are cages.

* * * * *